United States Patent [19]

Bungo et al.

[11] 4,009,924

[45] Mar. 1, 1977

[54] SPARK PLUG CONNECTOR ASSEMBLY

[75] Inventors: Edward M. Bungo, Warren, Ohio; Lloyd D. Jack, Birmingham, Mich.

[73] Assignee: General Motors Corporation, Detroit, Mich.

[22] Filed: Mar. 18, 1976

[21] Appl. No.: 668,031

[52] U.S. Cl. ..... 339/223 S; 339/259 R

[51] Int. Cl.[2] ..... H01T 13/04

[58] Field of Search ..... 339/223 S, 256 C, 258 C, 339/259 R, 259 F

[56] References Cited

UNITED STATES PATENTS

| | | | |
|---|---|---|---|
| 3,223,963 | 12/1965 | Rarey et al. | 339/259 R |
| 3,364,459 | 1/1968 | Schiller | 339/259 R |
| 3,813,645 | 5/1974 | Elliott et al. | 339/259 R |

*Primary Examiner*—Roy Lake
*Assistant Examiner*—Neil Abrams
*Attorney, Agent, or Firm*—J. F. Fodale

[57] ABSTRACT

A spark plug connector assembly comprises a sheet metal terminal and a spring clip embracing the forward barrel portion thereof. The clip has four dimples projecting through two forward slots and two rear slots of the barrel portion. The barrel portion is fore-shortened and the forward slots are open at the forward end of the terminal to prevent the terminal from binding on the spark plug terminal during detachment at high angles. The slot and dimple arrangement is such that proper assembly of the spring clip is assured and the spring clip is reversible. Tabs are also provided on the barrel portion to assure proper seating on the spark plug terminal.

7 Claims, 6 Drawing Figures

SPARK PLUG CONNECTOR ASSEMBLY

This invention relates generally to detachable electrical connectors and more particularly to a detachable electrical connector assembly particularly suited for connecting an ignition wire to a spark plug for an internal combustion engine.

In the past, various designs of ignition wire connectors have been employed many of which were formed from sheet metal blanks to provide, at one end thereof, a barrel portion of generally hollow cylindrical shape for circumferentially engaging the stud terminal of a spark plug. A generally axially extending split resulting from the forming operation of the barrel portion, provided some resilience in the barrel portion for purposes of attaching or detaching the ignition wire connector from the spark plug terminal.

Such resilient barrel portions have not been entirely satisfactory because the tendency is to bend and permanently distort the barrel portion especially during detachment of the ignition wire connector from the spark plug terminal.

Improvements have heretofore been proposed whereby means, such as a spring clip, are provided to embrace the barrel portion for preventing undue distortion thereof. See for instance, U.S. Pat. No. 3,223,963 issued to Robert S. Rarey and Elbert L. Johnson on Dec. 14, 1965 for an "Electrical connector" and U.S. Pat. No. 3,364,459 issued to Leslie L. Schiller on Jan. 16, 1968 for a "Universal Spark Plug Terminal Connector." In the arrangements disclosed in the aforementioned patents, detent means are provided on the spring clip for engaging portions of the spark plug terminal to prevent accidental detachment of the connector.

In the Schiller arrangement, however, desired detachment of the ignition wire connector from the spark plug terminal is often difficult to achieve because the connector must be detached in a substantially axial direction of the spark plug terminal or else the connector will bind against it resulting in high disengaging forces and possible permanent distortion of the connector barrel portion. A substantially axial disengagement is not always easily accomplished because of factors, such as for example, the physical location and position of the spark plugs on the engine.

While the Rarey arrangement poses a partial solution to the problem, it nevertheless requires an initial pull in a substantially axial direction after which the ignition wire connector may be cocked with respect to the spark plug terminal. However, even in this instance, the permissible cocking is limited to relatively small angles before high disengage forces are encountered.

In its broadest terms, the object of this invention is to improve upon the connectors shown in the aforementioned patents particularly in connection with the disengage forces which are required to detach the connector when its barrel portion is at a substantial angle with respect to the axis of the spark plug terminal.

The invention contemplates a shorter barrel portion, and thus material saving and other additional features which may be incorporated such as means to assure proper assembly of the spring clip, a reversible spring clip and means to insure proper seating of the barrel portion on the stud terminal.

Other objects and features of the invention will become apparent to those skilled in the art as the disclosure is made in the following detailed description of a preferred embodiment of the invention as illustrated in the accompanying sheet of drawing in which.

Figure 1:
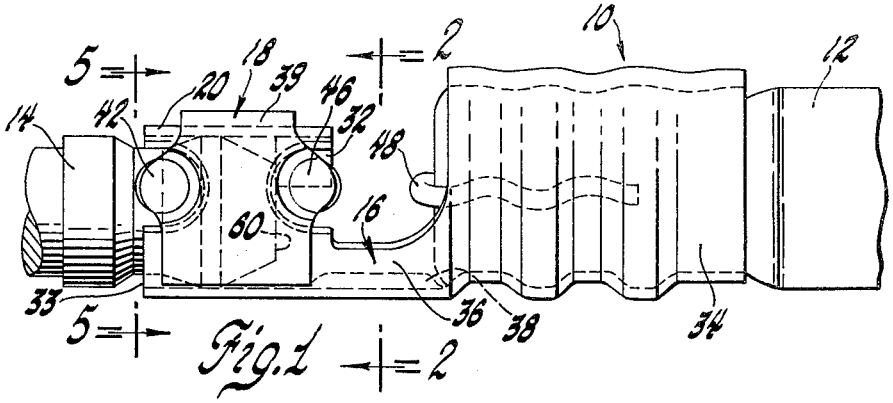
FIG. 1 is a side elevational view showing a spark plug connector assembly in accordance with this invention permanently attached to an ignition wire at one end and detachably connected to a spark plug stud terminal at the other end.
Figure 2:
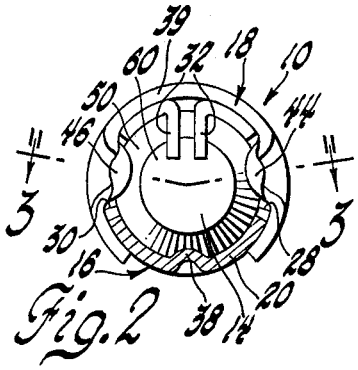
FIG. 2 is a section taken substantially along the line 2—2 of FIG. 1 looking in the direction of the arrows.
Figure 4:
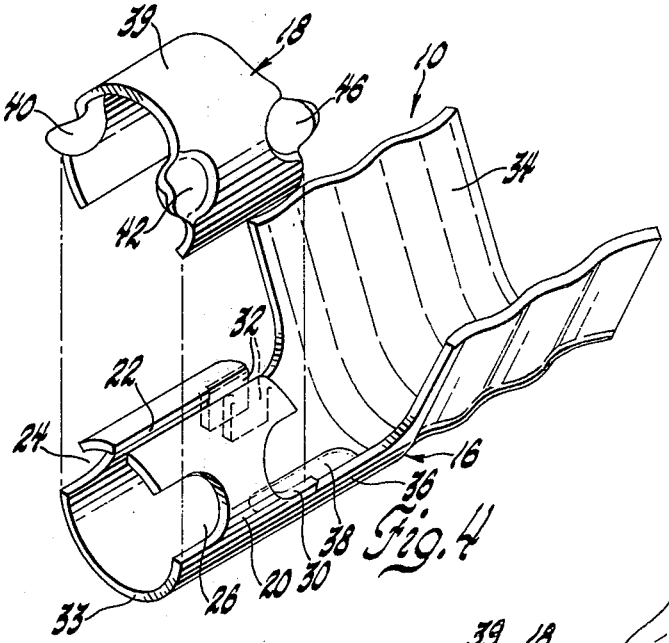
FIG. 4 is an exploded perspective view of the spark plug connector assembly shown in FIG. 1 prior to its attachment to the ignition wire.
Figure 5:
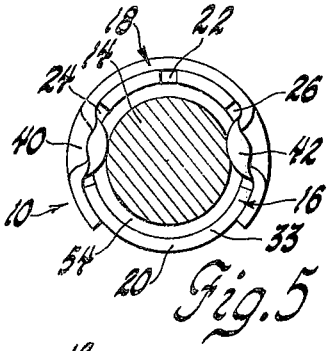
FIG. 5 is a section taken substantially along the line 5—5 of FIG. 1 looking in the direction of the arrows.

Referring now to the drawing, FIG. 1 illustrates a spark plug connector assembly 10 permanently attached to an ignition wire 12 at one end and detachably connected to a spark plug stud terminal 14 at the other end. As best illustrated in FIG. 4, the connector 10 is a two piece assembly comprising a stamped and bent, sheet metal terminal 16 and a C-shaped spring clip 18.

The terminal 16 has a forward barrel portion 20 which is bent to a generally cylindrical shape from a flat blank and thus has a longitudinal split 22. The barrel portion 20 has two forward circumferentially spaced slots 24 and 26 and two rearward circumferentially spaced slots 28 and 30. The slots 24 and 26 are chordally rather than diametrically opposed and located about 80° from opposite sides of the split 22. The slots 24 and 26 are longitudinally aligned with the slots 28 and 30 respectively. Each slot is open at an extremity of the barrel portion 20. That is, the slots 24 and 26 are open at the forward end of the barrel portion 20 which corresponds to the forward extremity of the terminal while the rear slots 28 and 30 are open at the rear end of the barrel portion 20. The barrel portion 20 also includes two inwardly bent stop tabs 32 contiguous the confronting edges of the barrel portion 20 at the rearward end of the split 22.

The barrel portion 20 of the terminal is connected to a crimpable attachment portion 34 (corrugated in longitudinal section) by an integral bridge portion 36. The bridge portion 36 is generally of part cylindrical cross section and is contiguous the portion of the barrel portion rear edge which is below the slots 28 and 30 and on the opposite side of the split 22. The bridge portion 36 also includes an oval shaped, inwardly raised stiffening rib 38.

The spark plug connector assembly 10 further comprises a C-shaped spring clip 18 having a substantially part cylindrical body 39 and four inwardly depressed dimple portions of generally part spherical shape. The dimple portions 40 and 42 project beyond one end of the body portion 39 while the dimple portions 44 and 46 project beyond the other end. The dimple portions 40 and 42 are circumferentially spaced and longitudinally aligned respectively with the dimple portions 44 and 46. The centers for generating the part spherical dimple portions have the same spatial arrangement as the centers for generating the semicylindrical portions of the slots 24, 26, 28 and 30. The arrangement of slots and dimples is symmetric to a single longitudinal plane substantially bisecting the split 22. Consequently, the clip 18 can only be attached to the barrel portion 20 in a position where the body 39 of the clip 18 covers the longitudinal split 22. Due to the symmetry however, the clip 18 may be turned end for end for assembly and the slots 24, 26, 28 and 30 may respectively receive either dimple portions 40, 42, 44 and 46 or dimple portions 46, 44, 40 and 42. In the assembled position, the dimple portions cooperate with the slots to substantially fix the position of the spring clip 18 with respect to the barrel in the longitudinal direction. The slots however may be oversize in the circumferential direction to permit some relative movement in the circumferential direction.

The crimpable attachment portion 34 as shown in FIG. 4 is trough shaped in cross section. It is utilized to permanently attach the terminal 16 to the ignition wire 12 in a conventional manner. More specifically, the ignition wire 12 has an end portion of the insulator jacket stripped away to expose a short length of the conductive core 48. The conductive core 48 is then bent back against the insulator jacket and trough shaped portion is tightly crimped therearound ending up in a generally cylindrical shape as shown in FIG. 1.

Figure 3:
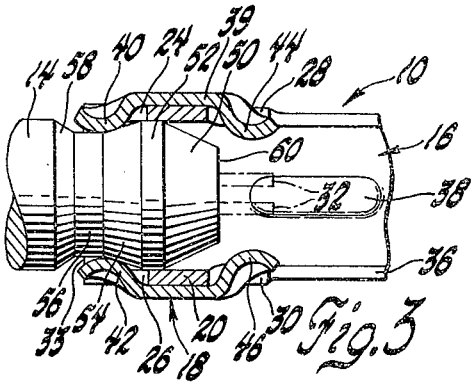
FIG. 3 is a section taken substantially along the line 3—3 of FIG. 2 looking in the direction of the arrows.

Once the terminal 16 is secured to the ignition wire 12 and the spring clip 18 is assembled, the connector assembly 10 may be repeatedly attached to and detached from the spark plug stud terminal 14 of standard configuration shown in FIG. 3. The standard spark plug stud terminal 14 comprises a diverging conical end portion 50, a cylindrical band portion 52, a converging conical portion 54, a cylindrical neck 56 and a tapered shoulder 58. When the connector assembly 10 is attached to the spark plug stud terminal 14, the dimple portions 40 and 42 snap past the cylindrical band portion 52 and engage the conical portion 54 to resist detachment and the tabs 32 engage the flat end surface 60 to prevent over insertion. The barrel portion 20 has a slip fit on the cylindrical band portion 52 and is generously spaced from other portions of the stud terminal 14 particularly with regards to its leading edge 33 which as can best be seen in FIG. 3 is slightly behind the leading edge of the dimples 40 and 42. Because of the forward location of the dimples 40 and 42 and inherent resilience of the parts, substantial universal movement between the connector assembly 10 and the spark plug stud terminal 14 is permitted without any appreciable binding therebetween. Consequently, the connector assembly 10 may be detached with a relatively low and constant disengage force when the axis of the barrel portion 20 is anywhere from 0° up to about 45° with respect to the axis of the stud terminal 14.

Figure 6:
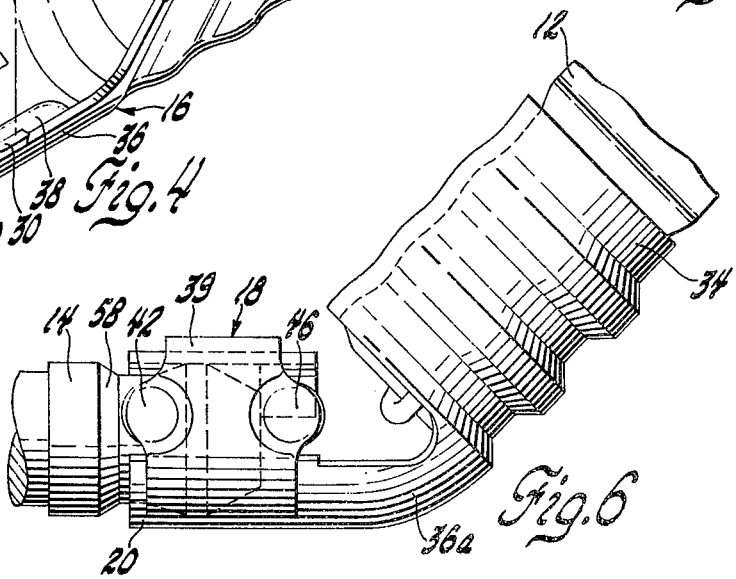
FIG. 6 is a side elevational view of a modified spark plug connector assembly in accordance with this invention.

The embodiment shown in FIGS. 1 through 5 is an in line connector, that is, the longitudinal axis of the barrel portion 20 is parallel to the longitudinal axis of the crimped attachment portion 34. This invention is also applicable to an angular type connector, for example, one in which the bridge portion 36*a* is bent so that the longitudinal axis of barrel portion 20 is at about 45° to the longitudinal axis of the crimped attachment portion 34 as shown in FIG. 6. The connector assembly shown in FIG. 6 is otherwise the same as that shown in FIGS. 1–5.

We wish it to be understood that we do not desire to be limited to the exact details of construction shown and described, for obvious modifications will occur to a person skilled in the art.

What is claimed is:

1. A connector assembly for detachably connecting an ignition wire to a spark plug stud terminal comprising, a terminal having an attachment portion at a rearward end for permanently attaching said terminal to an electrical wire and a barrel portion at a forward end for detachable connection to a stud terminal, said barrel portion having a longitudinal split and at least one slot which is open at the forward end of the terminal and which is circumferentially spaced from said longitudinal split, and a C-shaped spring clip embracing said barrel portion and spanning said longitudinal split to inhibit expansion of said barrel portion in the circumferential direction, said clip having a dimple portion at a forward end thereof disposed in said slot to limit rearward movement of said clip with respect to said barrel portion, said dimple portion extending radially inwardly of said barrel portion and having a leading edge which is substantially coplanar with or ahead of the forward end of the terminal, said clip further having a rearward portion engaging portions of said barrel portion spaced rearwardly of said slot to limit forward movement of said clip with respect to said barrel portion.

2. A connector assembly for detachably connecting an ignition wire to a spark plug stud terminal comprising, a terminal having an attachment portion at a rearward end for permanently attaching said terminal to an electrical wire and a barrel portion at a forward end for detachable connection to a stud terminal, said barrel portion having a longitudinal split and a pair of circumferential spaced chordally opposed slots each of which is open at the forward end of the terminal and circumferentially spaced from said longitudinal split, and a C-shaped spring clip embracing said barrel portion and spanning said longitudinal split to inhibit expansion of said barrel portion in the circumferential direction, said clip having a part-cylindrical body portion and a pair of circumferentially spaced dimple portions projecting beyond a forward end of the body portion and projecting through said slots, said dimple portions engaging juxtaposed portions of said barrel portion to maintain the forward end of the terminal substantially coplanar with or behind leading edges of said dimple portions, said clip further having a rearward portion engaging portions of said barrel portion rearwardly of said slots to limit forward movement of said clip with respect to said barrel portion.

3. A connector assembly for detachably connecting an ignition wire to a spark plug stud terminal comprising, a terminal having an attachment portion at a rearward end for permanently attaching said terminal to an electrical wire and a barrel portion at a forward end for detachable connection to a stud terminal, said barrel portion having a longitudinal slit and a first pair of circumferential spaced chordally opposed slots each of which is open at the forward end of the terminal and circumferentially spaced from said longitudinal split, said barrel portion having a second pair of circumferentially spaced chordally opposed slots each of which is spaced rearwardly of said first pair of slots and circumferentially spaced from said split, and a C-shaped spring climp embracing said barrel portion and spanning said longitudinal split to inhibit expansion of said barrel portion in the circumferential direction, said clip having a part-cylindrical body portion and a first pair of circumferentially spaced dimple portions projecting beyond a forward end of the body portion and projecting through said first pair of slots, said dimple portions engaging juxtaposed portions of said barrel portion to maintain the forward end of the terminal substantially coplanar with or behind leading edges of said first pair of dimple portions, said clip further having a second pair of circumferentially spaced dimple portions projecting beyond a rearward end of the body portion and projecting through said second pair of slots, said pair of dimples engaging juxtaposed portions of said barrel portion to limit forward movement of said clip with respect to said barrel portion.

4. The connector assembly as defined in claim 3 wherein said first pair of dimples are aligned with respective ones of the second pair of dimples in the longitudinal direction and wherein said dimples are arranged in a symmetric relationship to a single longitudinal plane whereby said C-shaped clip may be fitted to said barrel portion in either of two end for end orientations and may be fitted to said barrel portion only in a position where the C-shaped clip spans the split.

5. The connector assembly as defined in claim 4 wherein said barrel portion has a radially inwardly projecting tab adjacent a rearward end of said split for engaging an end of said stud terminal and maintaining said first pair of dimples in engagement with a converging surface spaced longitudinally from said last mentioned end.

6. The connector assembly as defined in claim 3 wherein said barrel portion has a radially inwardly projecting tab adjacent a rearward end of said split for engaging an end of said stud terminal and maintaining said first pair of dimples in engagement with a converging surface on said stud spaced longitudinally from said last mentioned end.

7. A connector assembly for detachably connecting an ignition wire to a spark plug stud terminal comprising, a terminal having an attachment portion at a rearward end for permanently attaching said terminal to an electrical wire and a barrel portion at a forward end for detachable connection to a stud terminal having a converging surface spaced longitudinally from an end thereof, said barrel portion having a longitudinal split and first slot means which are open at the forward end of the terminal and circumferentially spaced from said longitudinal split, a C-shaped spring clip embracing said barrel portion and spanning said longitudinal split to inhibit expansion of said barrel portion in the circumferential direction, said clip having a part-cylindrical body portion and dimple means projecting beyond a forward end of the body portion and projecting through said slot means, said dimple means engaging juxtaposed portions of said barrel portion to maintain the forward end of the terminal substantially coplanar with or behind leading edges of said dimple means, said clip further having a rearward portion engaging portions of said barrel portion rearwardly of said slot means to limit forward movement of said clip with respect to said barrel portion, and said barrel portion having radially inwardly extending tab means for maintaining said dimple means in engagement with said converging surface.

* * * * *

UNITED STATES PATENT AND TRADEMARK OFFICE

CERTIFICATE OF CORRECTION

PATENT NO. : 4,009,924

DATED : March 1, 1977

INVENTOR(S) : Edward M. Bungo et al

It is certified that error appears in the above-identified patent and that said Letters Patent are hereby corrected as shown below:

Title page, column 2, Attorney's name "J. F. Fodale" should be changed to -- F. J. Fodale --.

Column 1, line 28, "connector" should read -- Connector --.

Column 4, line 66, "slit" should read -- split --.

Column 5, line 7, "climp" should read -- clip --;

line 37, "4" should read -- 3 --.

Column 6, line 1, after "surface" insert -- on said stud --;

line 3, "3" should read -- 4 --;

line 8, after "surface" delete -- on said stud --.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*